US011225828B2

(12) United States Patent
Ratliff

(10) Patent No.: US 11,225,828 B2
(45) Date of Patent: Jan. 18, 2022

(54) SECURITY PANEL SYSTEM FOR WINDOWS

(71) Applicant: WINDOW ARMOR, LLC, Tiffin, OH (US)

(72) Inventor: Kenneth D. Ratliff, Tiffin, OH (US)

(73) Assignee: WINDOW ARMOR, LLC, Tiffin, OH (US)

( * ) Notice: Subject to any disclaimer, the term of this patent is extended or adjusted under 35 U.S.C. 154(b) by 253 days.

(21) Appl. No.: 16/288,167

(22) Filed: Feb. 28, 2019

(65) Prior Publication Data

US 2019/0271189 A1 Sep. 5, 2019

Related U.S. Application Data

(60) Provisional application No. 62/637,162, filed on Mar. 1, 2018.

(51) Int. Cl.
*E06B 5/10* (2006.01)
*E05B 65/08* (2006.01)

(52) U.S. Cl.
CPC ..... *E06B 5/10* (2013.01); *E05B 65/08* (2013.01); *E05Y 2900/132* (2013.01)

(58) Field of Classification Search
CPC ..... E06B 5/10
See application file for complete search history.

(56) References Cited

U.S. PATENT DOCUMENTS 1,749,237 A * 3/1930 Weinstein ..... E06B 5/10 49/171
2,624,922 A * 1/1953 Ackerman ..... E06B 7/30 49/38
9,097,497 B2 * 8/2015 Corsetti ..... F41H 5/08
9,145,729 B2 * 9/2015 Spransy ..... E05B 65/462
9,243,445 B2 * 1/2016 Beaudoin ..... E06B 7/28
9,651,340 B1 * 5/2017 Tunis, III ..... E06B 5/10
9,850,701 B1 * 12/2017 Arway ..... E06B 3/827
10,767,415 B2 * 9/2020 Coe ..... E06B 9/04
2008/0263958 A1 * 10/2008 Edson ..... E06B 7/30 49/56
2010/0155001 A1 * 6/2010 Bolton ..... G09F 3/20 160/368.1
2013/0092332 A1 * 4/2013 Johnsen ..... E06B 7/30 160/368.1
2015/0047236 A1 * 2/2015 Hamel ..... E06B 7/30 40/491
2016/0222720 A1 * 8/2016 Tamberino ..... E06B 9/0692
2016/0281416 A1 * 9/2016 Spransy ..... E05C 19/00
2016/0281419 A1 * 9/2016 Johnsen ..... E06B 9/24
2018/0106097 A1 * 4/2018 Ralston ..... E06B 7/04
2020/0270936 A1 * 8/2020 Sargent ..... E05B 65/08

* cited by examiner

*Primary Examiner* — Catherine A Kelly
(74) *Attorney, Agent, or Firm* — Jacob M. Ward; Ward Law Office LLC

(57) ABSTRACT

A security panel system that is adapted to protect innocent bystanders from gunfire in the event of a shooting. The security panel system includes a main body having a first rail, a second rail, a panel, and a locking mechanism. The first rail and the second rail may each be mounted adjacent to a window and movably secure a panel therebetween. The panel is movable between an opened position and a closed position. The locking mechanism is configured to secure the panel in the closed position. It should be appreciated that, while the panel is in the closed position, the shooter may not be able to see or fire through the window due to use of the security panel system.

20 Claims, 6 Drawing Sheets

SECURITY PANEL SYSTEM FOR WINDOWS

CROSS REFERENCE TO RELATED APPLICATIONS

This application claims the benefit of U.S. Provisional Application Ser. No. 62/637,162, filed on Mar. 1, 2018. The entire disclosure of the above application is hereby incorporated herein by reference.

FIELD

The present disclosure relates to security systems and, more particularly, a security panel system for use with windows.

BACKGROUND

The frequency of business- and school-related shooting events has worsened in recent years. The conventional construction of schools, in particular, makes security difficult when confronted with unauthorized intruders, or students, with firearms. Very often, shootings have occurred in schools where students have been trapped in in a room with the gunman outside the door.

There are numerous barricade devices available on the market. Known devices that are commercially available include the NIGHTLOCK® door barricade device, the BARRACUDA® intruder defense system, THE BOOT™ barricade device, and the BOLO STICK™ door barricade device, to name a few. These devices when deployed all serve the same function, namely, they are all essentially secondary locking systems. For example, THE BOOT™ barricade, which is commercially available from The Lockdown Co., located in Fowlerville, Mich., involves a rectangular-shaped plate of ¼-inch-thick cold-rolled industrial steel configured to be quickly placed at the base of a school door in a crisis.

However, known barricading devices such as THE BOOT™ barricade device do nothing to secure the windows that most school doors possess. Individuals in the classroom may be targeted through the window or the intruder may gain access to the classroom through a broken window. If the shooter is not able to open the door, the shooter may still insert his arm and weapon into the classroom through the opened window and blindly fire shots.

Accordingly, there is a need for a system to further secure business and school rooms in times of crisis, and especially in active shooter situations. Desirably, the system secures and protects the window of a room and militates against a would-be shooter from visualizing the occupants in the room and firing through the glass of the window.

SUMMARY

In concordance with the instant disclosure, a system to further secure business and school rooms in times of crisis, and especially in active shooter situations, and which secures and protects the window of a room and militates against a would-be shooter from visualizing the occupants in the room and firing through the glass of the window, has been surprisingly discovered.

In one embodiment, a security panel system includes a main body having a first rail, a second rail, a panel, and a locking mechanism. The first rail has a first channel and the second rail has a second channel. The panel is received by the first channel of the first rail and the second channel of the second rail. The panel is selectively movable between an opened position and a closed position. The locking mechanism is configured to secure the panel in the closed position automatically. The main body is configured to attach to a mounting surface.

In another embodiment, a method of securing a room with a window includes steps of providing a security panel system and providing a mounting surface with the window. The first rail and the second rail are then secured adjacent to the window. The panel is then disposed between the first rail and the second rail, with the window being fully covered where the panel is moved to the closed position. Importantly, an occupant of the room is not viewable by an assailant outside the window.

In a further embodiment, a kit for the security panel system includes separately provided or individual components of the security panel system as described. In particular, the kit may include a panel configured to be selectively movable between an opened position and a closed position, a first rail having a first channel, and a second rail having a second channel. The first rail and the second rail are each configured to attach to a mounting surface. Each of the first channel of the first rail and the second channel of the second rail are also configured to receive the panel. The kit also includes a locking mechanism configured to be attached to the first rail and secure the panel in the closed position. Fasteners and a back plate may also be provided for securing the components of the kit to the mounting surface adjacent the window. Tools to facilitate the assembly may also be provided with the kit.

In an exemplary embodiment, the security panel system may include a shutter panel that is either hinged or sliding, and which selectively covers the classroom window from the inside, in the event of an active shooter situation. The shutter panel may be formed from a steel plate. The shutter panel covers the transparent door glass and militates a shooter from gaining access to the classroom by shooting out the glass.

In operation, the shutter panel will slide horizontally across the window on rails at the top and bottom of the window, and a locking mechanism will hold it in place. The shutter panel and rails may be permanently mounted to the door. The individual deploying this system will simply slide the shutter panel as far as it can go toward the window, and it will then lock into place automatically without requiring a secondary locking action by the individual. Once the system is in operation, an active shooter will be unable to see into the room and will not be able to reach a hand into the room to either gain access to the room or to extend a firearm into the room and fire rounds blindly around the room.

The shutter panel and rails may be of a thickness and configuration that militate against them from being knocked out of the window with a maximal strike by a hand of the assailant or a butt of a weapon. Likewise, the material of the shutter and rails may be bullet resistant. It should be appreciated that while bullet resistant material may stop rounds of certain caliber, the shutter plate may not necessarily be entirely bullet proof. Indeed, a wood door itself is not bullet proof to all caliber of rounds. Thus, occupants may still be trained to stay out of the line of fire should the shooter decide to blindly shoot through the door around the security panel system.

The basic design for the system will be the same for classroom door windows of any width, by simple altering the dimensions of the shutter panel and rail components. Doors with half-glass windows on the top of half of the door will have larger steel plates that would slide vertically, and the shutter panel would again automatically lock into place upon being closed.

It should be appreciated that, prior to the shutter system of the present disclosure, no such device has been available for purchase. There is a significant need for such devices in businesses and schools nationwide. The shutter system may be installed on the interior, classroom side of the door. In an active shooter situation, or on command for a lockdown situation, an occupant in the room (for example, the teacher) will simply slide the shutter panel over the classroom door window. The system will have a locking mechanism that will militate against the shutter from being opened from outside the door. The locking mechanism may be a spring-loaded plunger, for example, or any other suitable device mounted to the rail that secures the shutter once it has been moved to the closed position. The locking mechanism militates against the shooter from sliding the shutter back open from outside the door. At the all clear notification, the teacher will manually release the lock and move the shutter back to the opened position.

In a most particular embodiment, the shutter panel is plate steel that is about three sixteenths of an inch (3/16") in thickness. The sides are bent up one inch (1") on each side of the shutter panel to add strength and provide a handle to close and open the shutter. The rails may be a U-channel that the bottom and top of the shutter panel rest in and move back and forth like a sliding patio door. However, one of ordinary skill in the art may also select other types of rail configurations within the scope of the present disclosure.

DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
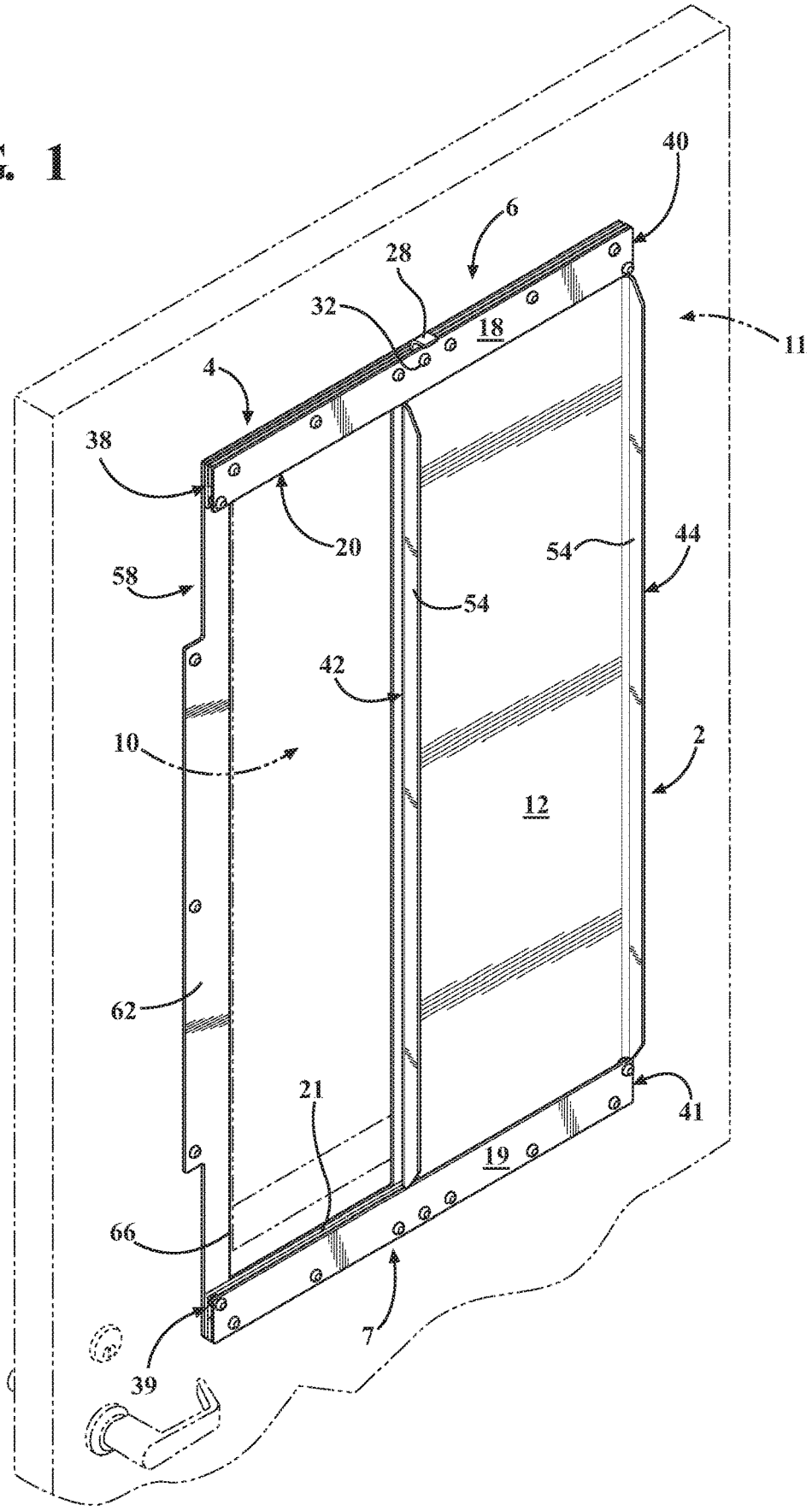
FIG. 1 is a top perspective view of a security panel system according to one embodiment of the present disclosure, where a panel of the security panel system is shown in an opened position and mounted adjacent to a window of a mounting surface such as a door.

The following description is merely exemplary in nature and is not intended to limit the present disclosure, application, or uses. It should be understood that throughout the drawings, corresponding reference numerals indicate like or corresponding parts and features.

The present disclosure includes a security panel system 2, a method 100 for installing the security panel system 2, and an associated kit for installation of a security panel system 2, each of which are adapted to protect innocent bystanders, who may be present as occupants in windowed rooms, from gunfire in the event of an active shooter situation.

With reference to FIGS. 1-7, the security panel system 2 may include a main body 4 having a first rail 6 and a second rail 7. The first rail 6 and the second rail 7 may each be mounted adjacent to a window 10 formed in a mounting surface 11. Although the mounting surface 11 containing the window 10 is shown in FIGS. 1-7 as being an interior surface of a door, it should be appreciated that the mounting surface 11 may also be an interior surface of a building wall containing the window 10, within the scope of the present disclosure.

Figure 3:
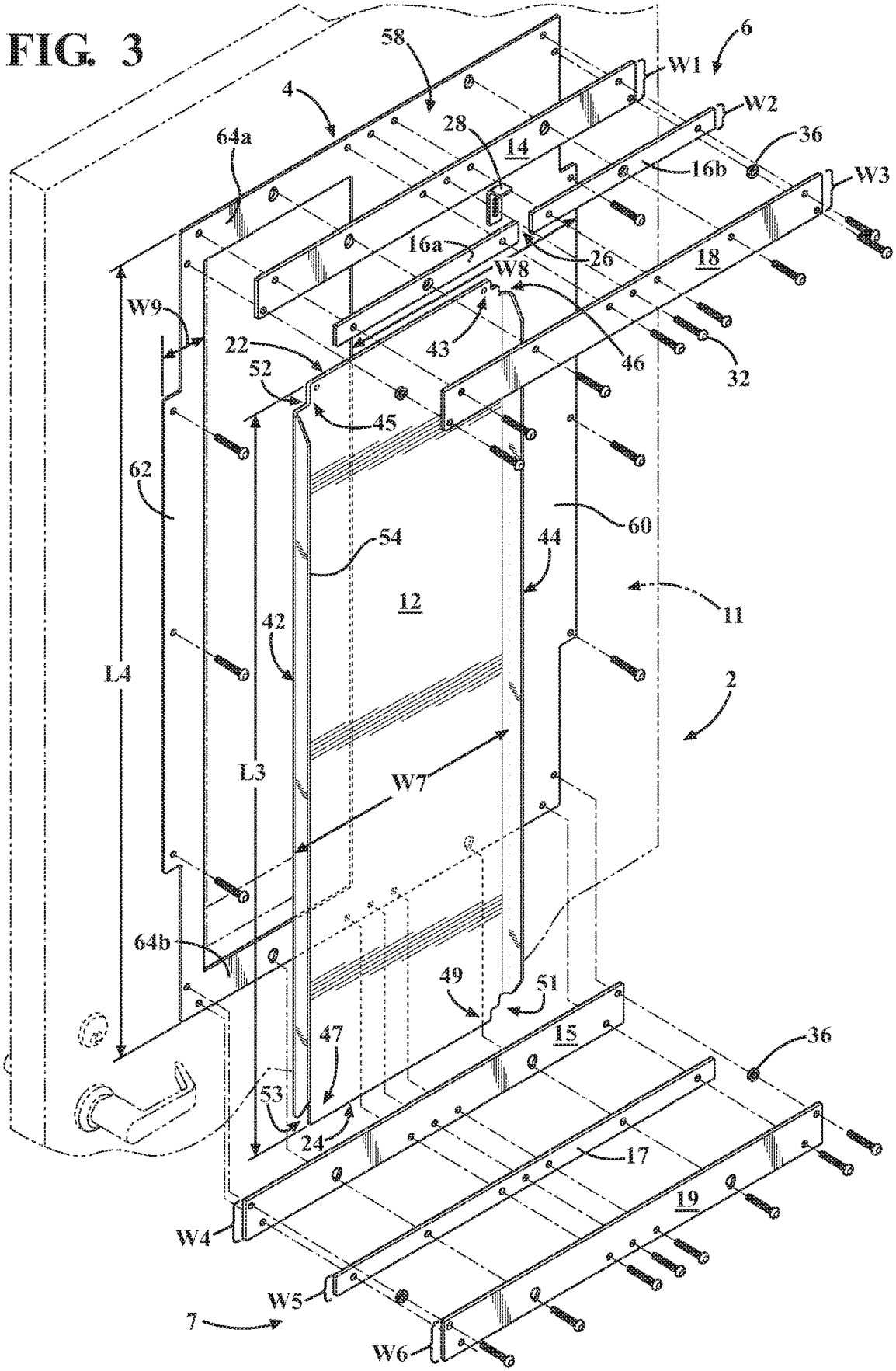
FIG. 3 is an exploded, top perspective view of the security panel system shown in FIG. 2, and further illustrating the construction of rails of the security panel system according to one embodiment of the disclosure.

With reference to FIG. 3, it should be appreciated that the main body 4 may be secured to the mounting surface 11 with fasteners 32. For example, the fasteners 32 may include mechanical fasteners such as bolts, screws, rivets, pins, and the like. Further structure such as nuts and washers may also be employed with the fasteners 32. The fasteners 32 may also include chemical fasteners such as adhesives. Advantageously, the fasteners 32 permit for a robust attachment of the main body 4 to the mounting surface 11 and militate against a removal or movement of the main body 4 away from the window 10 in an emergency such as an active shooter situation. One of ordinary skill in the art may also select other suitable means and types of fasteners 32 within the scope of the present disclosure.

A panel 12 is movably received by each of the first rail 6 and the second rail 7. In particular, the panel 12 may be slidably disposed in each of the first rail 6 and the second rail 7, which in turn may be substantially C- or U-shaped in cross section. For example, the first rail 6 may have a first channel 20 and the second rail may have a second channel 21, which may receive opposite ends of the panel 12 to slidably secure the panel 12 between the first rail 6 and the second rail 7. In particular, the panel 12 is movable between an opened position (shown in FIG. 1) and a closed position (shown in FIG. 2). The panel 12 is adapted to uncover the window 10 where in an opened position, and to cover an entirety of the window 10 where in the closed position.

As shown in FIGS. 1-7, the main body 4 of the security panel system 2 may be mounted to the interior or mounting surface 11 of the windowed door. In this embodiment, where the panel 12 is in the closed position (shown in FIG. 2), it should also be appreciated the panel 12 not only blocks the view to the active shooter of any occupants in the room, but also militates against the active shooter being able to shoot out the window pane and reach through the window 10 to open the door, which will be locked in such situations, and gain access to the room.

Although the first rail 6 and the second rail 7 may each be formed as a singular, one-piece construction, it should be appreciated that the first rail 6 and the second rails 7 may also be formed by assembly of multiple components.

In one example, with reference to FIG. 3, the first rail 6 of the main body 4 may include a first inner member 14, a first spacing member 16*a*, 16*ba*, 16*b*, and a first outer member 18. The first spacing member 16*a*, 16*b* a, 16*b* may have of a width (W2) that is less than a width (W1) of the first inner member 14 and a width (W3) of the first outer member 18. The relative dimensions of the first inner member 14, the first spacing member 16*a*, 16*ba*, 16*b*, and the first outer member 18 may thereby define the first channel 20 upon assembly to form the first rail 6. Likewise, a depth of the first channel 20 may be defined by a difference between the width (W2) of the first spacing member 16*a*, 16*ba*, 16*b* and either of the widths (W1, W3) of the first inner member 14 and the first outer member 18.

Figure 2:
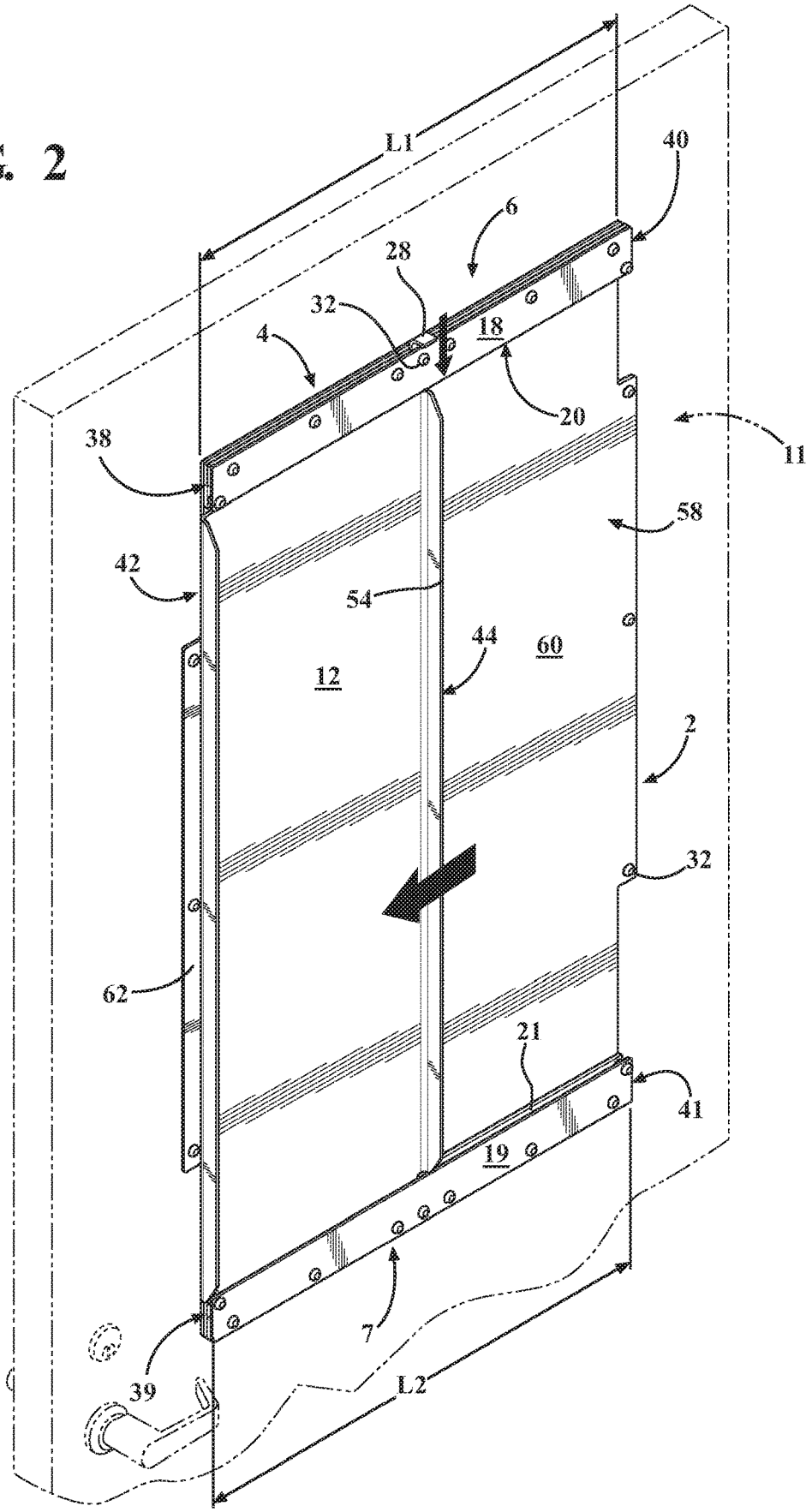
FIG. 2 is a top perspective view of the security panel system shown in FIG. 1, where the panel is shown in a closed position and securing the window, with arrows indicating a direction of movement of the panel from the opened position to the closed position and a direction of movement of a locking mechanism from an unlocked position to a locked position.

In particular, the first inner member 14 may have the width (W1) between about one inch (1") and about three inches (3"), and most particularly about two inches (2"). In another example, the first spacing member 16*a*, 16*b* may have the width (W2) between about one-half inch (0.5") and about one-and-one-half inches (1.5"), and most particularly about one inch (1"). In a further example, the first outer member 18 may have the width (W3) between about one inch (1") and about three inches (3"), and most particularly about two inches (2"). Thus, in this non-limiting example, the depth of the first channel 20 may be between about one-half inch (0.5") and about one-and-one-half inches (1.5"), and most particularly about one inch (1"). As shown in FIG. 2, the first inner member 14, the first outer member 18, and the first spacing member 16*a*, 16*b* may also be of a length (L1) between about eighteen inches (18") and twenty-six inches (26"), and most particularly about twenty-two inches (22").

In another example, and with continued reference to FIG. 3, the second rail 7 may include a second inner member 15, a second spacing member 17, and a second outer member 19. The second spacing member 17 may have of a width (W5) that is less than that of a width (W4) of the second inner member 15 and a width (W6) of the second outer member 19 The relative dimensions of the second inner member 15, the second spacing member 17, and the second outer member 19 may thereby define the second channel 21 upon assembly to form the second rail 7. Likewise, a depth of the second channel 21 may be defined by a difference between the width (W5) of the second spacing member 17 and either of the widths (W1, W3) of the second inner member 15 and the second outer member 19.

In particular, the second inner member 15 may have the width (W4) between about one inch (1") and about three inches (3"), and most particularly about two inches (2"). In another example, the second spacing member 17 may have the width (W5) between about one-half inch (0.5") and about one-and-one-half inches (1.5"), and most particularly about one inch (1"). In further example, the second outer member 19 may have the width (W6) between about one inch (1") and about three inches (3") and most particularly about two inches (2"). Thus, in a non-limiting example, the depth of the second channel 21 may be between about one-half inch (0.5") and about one-and-one-half inches (1.5"), and most particularly about one inch (1"). As shown in FIG. 2, the second inner member 15, the second outer member 19, and the second spacing member 17 may also be of a length (L2) between about eighteen inches (18") and twenty-six inches (26"), and most particularly about twenty inches (22").

Although various specific widths (W1, W2, W3, W4, W5, W6) and lengths (L1, L2) of the first and second inner members 14, 15, the first and second spacing members 16, 17, and the first and second outer members 18, 19 assembled together to form the first rail 6 and the second rail 7 are described hereinabove, it should be understood that one skilled in the art may select any other suitable dimensions for the first and second inner members 14, 15, the first and second spacing members 16, 17, and the first and second outer members 18, 19, as desired.

It should be appreciated that each of the first rail 6, the second rail 7, and the panel 12 may be manufactured from a bullet-resistant material. The bullet-resistant material may include, as non-limiting examples, as steel, KEVLAR® aramid polymer, LEXAN® polycarbonate, carbon fiber composite materials, titanium, and combinations thereof. In one particular example, the panel 12, each of the first and second inner members 14, 15, and each of the first and second outer members 18, 19 may be about a 7-gauge steel (about 0.1875 inch in thickness). However, it should be appreciated that any other suitable bullet-resistant materials and thicknesses may be chosen for the panel 12, and likewise for each of the first and second inner members 14, 15 and each of the first and second outer members 18, 19, within the scope of the present disclosure.

Advantageously, the material selected for the panel 12 is also opaque. Being opaque, it should be appreciated that where the panel 12 is in the closed position the panel 12 may militate against the active shooter from viewing and shooting at the occupants through the window 10. Thus, the panel 12 serves two purposes, namely, to be resistant to puncture or penetration by bullets, and to also ensure that the active shooter cannot visually target occupants through the otherwise transparent window into the room.

As disclosed hereinabove, the panel 12 may be slidably disposed within the first channel 20 of the first rail 6 and the second channel 21 of the second rail 7. In order to facilitate a sliding of the panel 12, it should be appreciated that the first channel 20 and the second channel 21 may include features such as reduced-friction materials or bearings. These features are provided in order to allow for a rapid manual movement of the panel 12 to the closed position in operation.

In certain examples, each of the first and second spacing members 16, 17 may be formed from a polymer with a low coefficient of friction but suitable abrasion resistance. Polymers that are self-lubricating are also contemplated. In a most particular example, the polymer selected for the first and second spacing members 16, 17 may include ultra high molecular weight polyethylene or UHMPWE. Other polymers and coatings with low-coefficient of frictions, including polytetrafluorethylene or PTFE, may also be employed. One skilled in the art may select any other suitable material for the first and second spacing members 16, 17 within the scope of the present disclosure.

In other examples, the first channel 20 and the second channel 21 may include a lubricant (not shown) to facilitate the movement of the panel 12 within the first channel 20 and the second channel 21. In particular embodiments, the lubricant may be an oil, grease, or dry lubricant, such as graphite powder, molybdenum disulfide, or silicone. A skilled artisan may also select other suitable lubricants, as desired.

With renewed reference to FIGS. 1-2, the panel 12 may have a first end portion 22 and a second end portion 24. As established hereinabove, the first channel 20 and the second channel 21 are each configured to receive one of the first end portion 22, 24 of the panel 12. For example, each of the first rail 6 and the second rail 7 may be oriented so the first channel 20 of the first rail 6 faces the second channel 21 of the second rail 7. The first end portion 22 of the panel 12 may be slidably secured within the first channel 20, and the second end portion 24 of the panel 12 may be slidably secured within the second channel 21.

As shown in FIGS. 4-7, it should also be appreciated that where the first end portion 22 of the panel 12 is disposed in the first channel 20, the first end portion 22 may be disposed adjacent to, but spaced apart from, the first spacing member 16*a*, 16*b*. Where the second end portion 24 of the panel 12 is disposed in the second channel 21, the second end portion 24 may rest upon and slidably abut the second spacing member 17. In other words, a distance between facing surfaces of each of the first channel 20 and the second channel 21 may be slightly less than a height of the panel 12, so that the panel 12 is not immovably fixed in place by friction between the first rail 6 and the second rail 7. Once secured in the first and second channels 20, 21 of the first and second rails 6, 7, the panel 12 may therefore be selectively and manually slid between the opened position and the closed position.

In particular examples, with renewed reference to FIG. 3, the panel 12 may have a width (W7) that in the closed position is adapted to cover an entirety of a portion of the window 10, which portion is otherwise open and exposed where the panel 12 is in the opened position. In particular examples, the width (W7) may be between about twelve inches (12") and about sixteen inches (16") and most particularly about fourteen inches (14"). The panel 12 may also have a length (L3) between about thirty-two inches (32") and about forty-two inches (42"), and most particularly about thirty-eight inches (38"). One skilled in the art may also select any other suitable dimensions for the panel 12, as desired.

In a further example, each of the first and second end portions 22, 24 of the panel 12 may be provided with a smooth or rounded edge. For example, the rounding of the first and second end portions 22, 24 may be provided by a grinding process, or may be the result of a coating of the first and second end portions 22, 24 with a corrosion resistant coating. The rounding of the first and second end portions 22, 24 may minimize friction between the panel 12 and each of the first and second spacing members 16, 17 of the first and second rails 6, 7, for example, which in turn advantageously requires less force to move the panel 12 between the opened position and the closed position. It should be appreciated that ability to rapidly close of the panel 12 is especially necessary in the case of active shooter situations.

With renewed reference to FIGS. 1-7, the security panel system 2 of the present disclosure further includes a locking mechanism 28. The locking mechanism 28 is configured to secure the panel 12 in the closed position upon being manually and selective slid to the closed position from the opened position. For example, the locking mechanism 28 may be movable between an unlocked position (shown in FIGS. 1 and 4) and a locked position (shown in FIGS. 2 and 5). It should be understood that the locking mechanism 28 may advantageously function to immovably secure the panel 12 in the closed position automatically upon the panel 12 being moved to the closed position, without requiring any separate action from the user moving the panel 12. This is especially important in active shooter situations, where time is of the essence.

Figure 4:
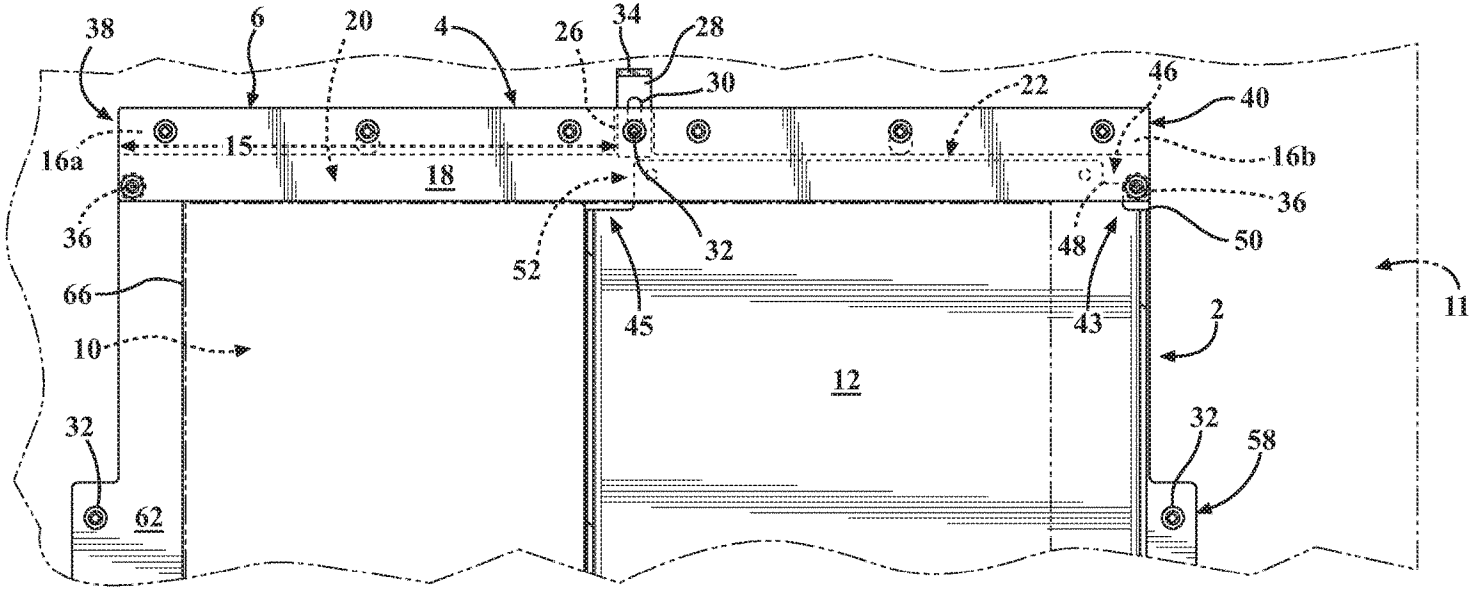
FIG. 4 is an enlarged, fragmentary, front elevational view of a first rail of the security panel system shown in FIG. 1, and further showing a first end of the panel, a locking mechanism, and an indentation of the panel in phantom lines, the locking mechanism shown disengaged from the indentation of the panel, where the panel is in the opened position.

As shown in FIG. 3, the locking mechanism 28 may be received by a gap 26 formed in the first rail 6. In particular, the first spacing member 16*a*, 16*b* of the first rail 6 may include a first spacing portion 16*a* and a second spacing portion 16*b*, which are spaced apart from each other and define the gap 26 therebetween. For example, as shown in FIG. 4, each of the first spacing portion 16*a* and the second spacing portion 16*b* may have a length (L5) between about nine inches (9") and about thirteen inches (13"), and most particularly about eleven inches (11"). A skilled artisan may also select other suitable dimensions for the first spacing portion 16*a* and the second spacing portion 16*b*, and the resulting gap 26 formed therebetween, and the resulting locking mechanism 28 received by the gap 26, as desired.

Figure 5:
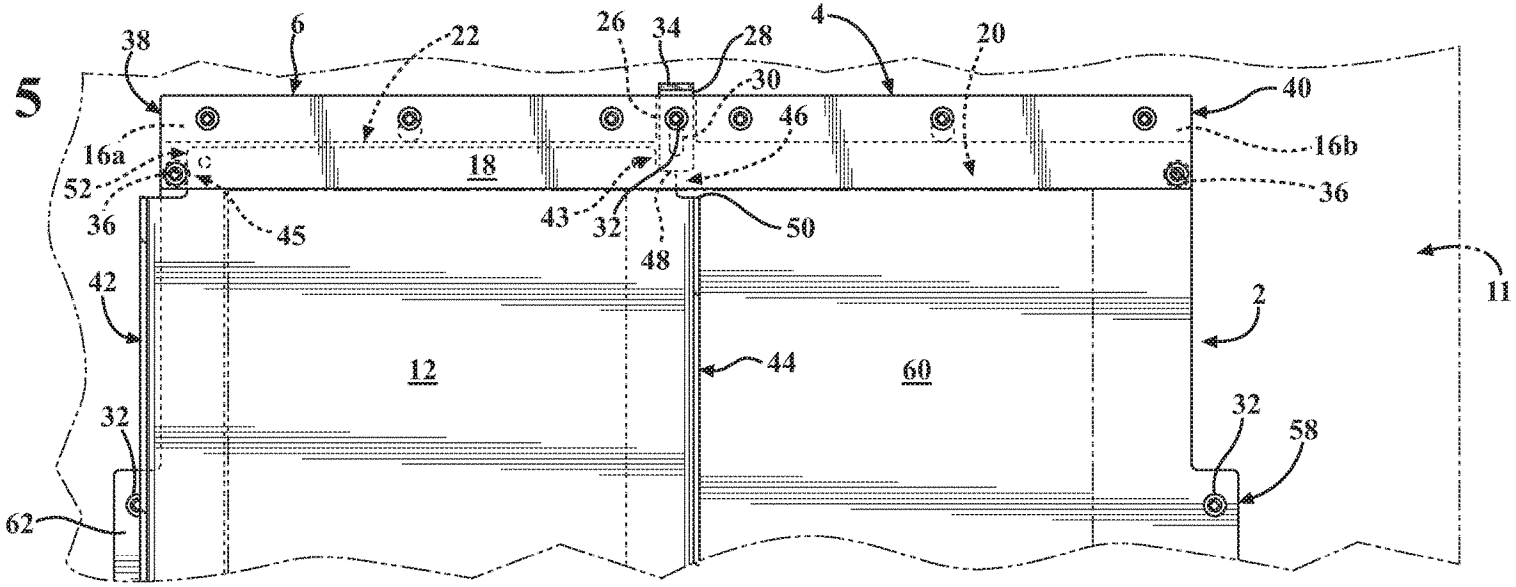
FIG. 5 is an enlarged, fragmentary, front elevational view of the first rail shown in FIG. 2, and further showing the first end of the panel, the locking mechanism, and a recess of the panel in phantom lines, the locking mechanism shown engaged with the recess of the panel, where the panel is in the closed position.

With renewed reference to FIGS. 3-5, the locking mechanism 28 of the present disclosure may have include a bolt body. The bolt body may have an elongate aperture 30 that is adapted to receive one of the fasteners 32, for example, which in turn militates against the bold body being removed from the first rail 6. The bolt body may be vertically movable within the gap 26 even though its removal is militated against by one of the fasteners 32.

As disclosed hereinabove, the bolt body may also have a grip portion 34, which allows a user to hold and lift the bolt body from the locked position to the unlocked position, which in turn allows the user to return the panel 12 back to the open position following the emergency. The grip portion 34 may be formed by bending or angling an upper portion of the bolt body, for example. A handle or knob may alternatively be disposed on the upper portion of the bolt body to provide the grip portion 34, for example. Other means for the grip portion 34 are also contemplated and considered within the scope of the disclosure.

It should be appreciated that the bolt body of the locking mechanism 28 may be adapted to automatically move from the unlocked position to the locked position under the force of gravity, as described further herein. However, one skilled in the art may also select other suitable means for moving the locking mechanism to the locked position with the scope of the present disclosure, such as a pin, a spring-loaded plunger, and a latch, as non-limiting examples.

With reference to FIGS. 3-7, the first rail 6 and the second rail 7 may also have a plurality of secondary spacing members 36, which are adapted to both maintain an integrity of the first and second channels 20, 21, and maintain the panel 12 within the first and second fails 6, 7 following assembly. In particular, the secondary spacing members 36 are disposed in the first channel 20 and the second channel 21. The secondary spacing members may be substantially O-shaped and also held in place within the first channel 20 and the second channel 21 by the fasteners 32. In one example, the plurality of secondary spacing members 36 may include at least two secondary spacing members 36 that are disposed between the first inner member 14 and the first outer member 18 within the first rail 6. In another example, the plurality of secondary spacing members 36 may include at least two secondary spacing members 36 that are disposed between the second inner member 15 and the second outer member 19 within the second rail 7.

Furthermore, the first rail 6 and the second rail 7 may each have a first terminal end 38, 39 and a second terminal end 40, 41. The at least one of the secondary spacing members 36 may be disposed in the first channel 20 adjacent to the first terminal end 38 of the first rail 6, and at least one of the spacing members 36 may be disposed adjacent to the second terminal end 40 of the first rail 6. Similarly, at least one of the secondary spacing members 36 may be disposed in the second channel 21 adjacent to the first terminal end 39 of the second rail 7, and at least one of the secondary spacing members 36 may be disposed in the second channel 21 adjacent to the second terminal end 41 of the second rail 7. It should be appreciated that the secondary spacing members 36, located thusly, are adapted to militate against the panel 12 being inadvertently removed from from the first channel 20 and the second channel 21 of the first rail 6 and the second rail 7, respectively. Other suitable shapes and locations for the secondary spacing members 36 may also be employed, as desired.

Figure 6:
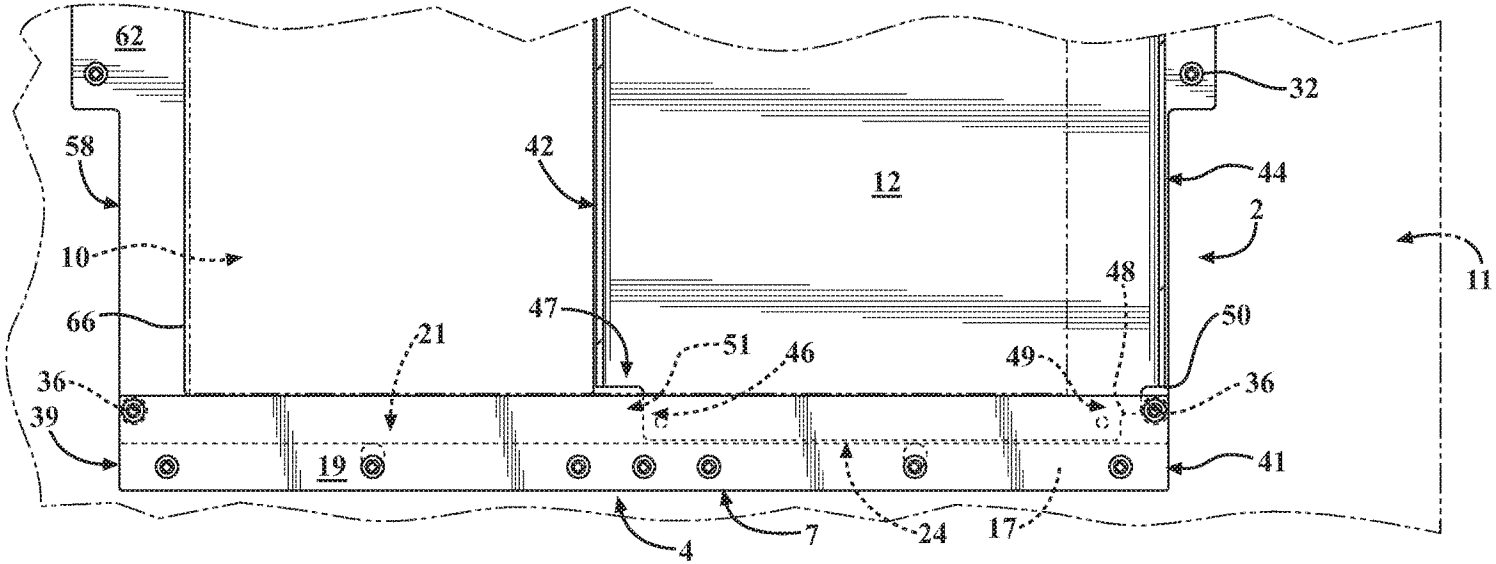
FIG. 6 is an enlarged, fragmentary, front elevational view of a second rail of the security panel system shown in FIG. 1, and further showing the panel, an indentation of the panel, and a recess of the panel in phantom lines, where the panel is in the opened position.
Figure 7:
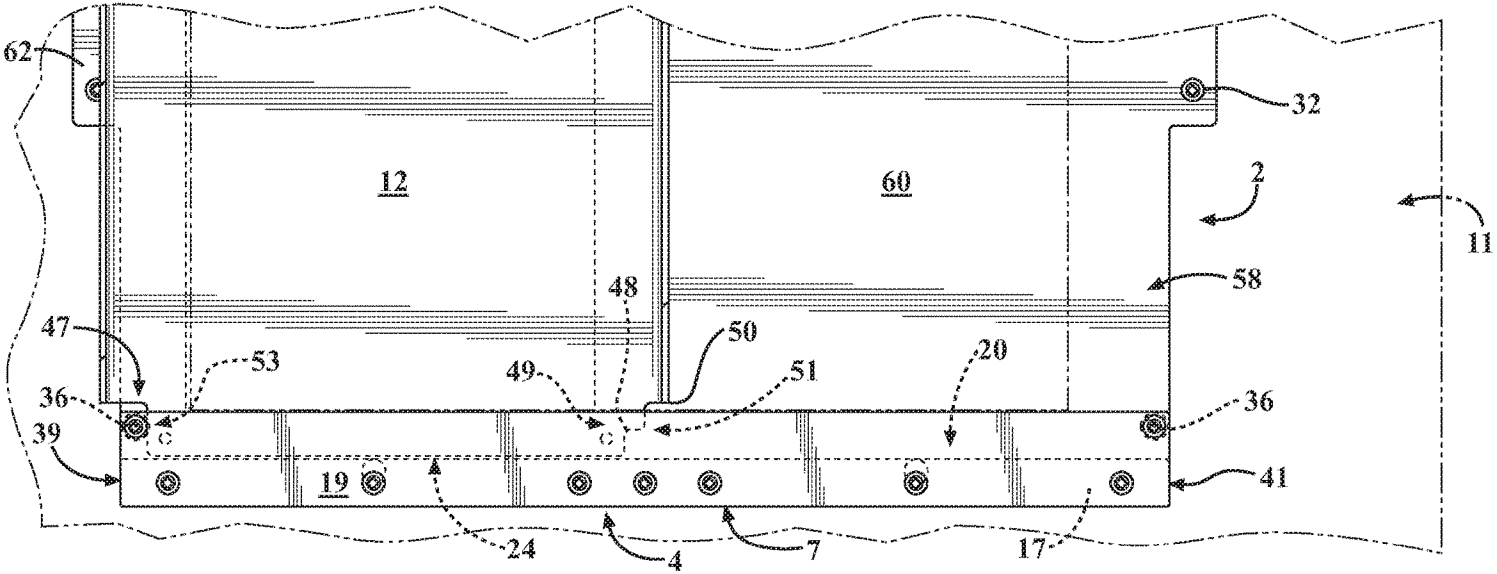
FIG. 7 is an enlarged, fragmentary, front elevational view of the second rail shown in FIG. 2, and further showing the panel, the indentation, and the recess in phantom lines, where the panel is in the closed position.

The secondary spacing members 36 may further function as a hard stop for the panel 12 where moved to either the closed position or the opened position. For example, the panel 12 of the present disclosure has a first side 42 and a second side 44. Where the panel 12 is in the closed position, as shown in FIGS. 5 and 7, the first side 42 of the panel 12 may be configured to abut the secondary spacing member 36 adjacent to the first terminal end 38 of the first rail 6, and also the secondary spacing member 36 adjacent to the first terminal end 39 of the second rail 7. Where the panel 12 is in the opened position, as shown in FIGS. 4 and 6, the second side 44 of the panel 12 may be configured to abut the secondary spacing member 36 adjacent to the second terminal end 40 of the first rail 6, and also the secondary spacing member 36 adjacent to the second terminal end 41 of the second rail 7.

In particular embodiments, as also shown in FIGS. 3-7, the first end portion 22 of the panel 12 may have a first corner 43 and a second corner 45, and the second end portion 24 of the panel 12 may have a third corner 47 and fourth corner 49. As shown in FIG. 3, the first corner 43 of the panel 12 may have a first recess 46 formed therein, and the fourth corner 49 of the panel 12 may have a second recess 51 formed therein. Each of the recesses 46, 51 is disposed adjacent the second side 44 of the panel 12. The first recess 46 may be formed in the first end portion 22 of the panel 12, while the second recess 51 may be formed in the second end portion 24 of the panel 12.

Similarly, the panel 12 may have a first indentation 52 formed in the second corner 45 of the panel 12, and a second indentation 53 formed in the third corner 47 of the panel 12. Each of the indentations 52, 53 may be disposed adjacent the first side 42 of the panel 12. The first indentation 52 may be formed in the first end portion 22 of the panel 12, while the second indentation 53 may be formed in the second end portion 24 of the panel 12. It should be appreciated that the provision of the indentations 52, 53 and the recesses 46, 51 at both the first and second end portions 22, 24 allows the panel 12 to be rotated and mounted in different orientations, as desired.

As shown in FIG. 4, the first end portion 22 of the panel 12 may be configured to normally abut the bolt body of the locking mechanism 28 and support the locking mechanism 28 in the unlocked position where the panel 12 is in the opened position. Additionally, as shown in FIG. 5, the first recess 46 formed at the first corner 43 of the panel 12 is configured to receive the locking mechanism 28 in the locked position, where the panel 12 is moved to the closed position.

The first and fourth corners 43, 49 may also have a contoured edge, which defines a first step 48 and a second step 50 of each of the recesses 46, 51. The first step 48 of the first recess 46 is adapted to interact with the locking mechanism 28 where in the locked position (as shown in FIG. 5) and the second step 50 of the first recess 46 is adapted to interact with one of the secondary spacing members 36 (as shown in FIG. 4). In particular, as shown in FIG. 5, the first step 48 of the first corner 43 may be adapted to abut the bolt body of the locking mechanism 28 where the bolt body is received by the recess 46 in the locked position, and where the panel 12 is in the closed position.

The second steps 50 may be configured to abut the secondary spacing members 36, which function as hard stops where the panel 12 is in the opened position, as shown in FIGS. 4 and 6. The second steps 50 may also permit the second side 44 of the panel 12 to be substantially co-planar with the second terminal end 40, 41 of the first and second rails 6, 7 where the panel 12 is in the opened position. Likewise, where the panel 12 is in the opened position, the second steps 50 of the recesses 46, 51 may also permit the second side 44 of the panel 12 to be substantially co-planar with the second terminal end 40, 41 of the first and second rails 6, 7. This arrangement may militate against any undesirable overhang of the panel 12 outside of the first and second rails 6, 7 where the panel is in the opened position.

With reference to FIGS. 5 and 7, where the panel 12 is in the closed position, the indentations 52, 53 may be configured to receive the secondary spacing members 36 adjacent to the first terminal end 38 of the first rail 6. It should be appreciated that the first indentation 52 permits the first side 42 of the panel 12 to slightly overhang the first terminal ends 38, 39 of the first and second rails 6, 7 where the panel 12 is in the closed position. This overhang advantageously minimizes an opportunity for an assailant to view occupants of the room through the window 10 when the panel 12 is otherwise closed.

Additionally, with renewed reference to FIGS. 1-7, each side of the panel 12 may be bent or angled in order to add strength and provide a handle 54. The handle 54 facilitates the manual movement of the panel between the closed position and the opened position. In a non-limiting example, each of the first side 42 and the second side 44 of the panel 12 may have the handle 54, which is angled outwardly at roughly a ninety degree (90°) angle relative to a major surface of the panel 12, and away from the window 10 and the mounting surface 11 upon assembly. The handle 54 may have a length of about one inch (1"), in a particular embodiment. Alternatively, the panel 10 may have a knob or U-shaped grip affixed thereto to provide the handle 54. Other suitable means, shapes and dimensions for the handle 54 may also be employed by a skilled artisan within the scope of the disclosure.

In particular embodiments, the main body 4 of the present disclosure may further include a back plate 58. The back plate 58 is adapted to be affixed to the mounting surface 11, and between the first and second rails 6, 7 and the mounting surface 11. For example, the back plate 58 may be affixed to the mounting surface with one or more of the fasteners 32. The back plate 58 has been found particularly advantageous where the first and second rails 6, 7 otherwise prove difficult to affix to the mounting surface 11, for example, due to inconstancies or irregularities in the mounting surface 11. The back plate 58 may provide a substantially uniform mounting area, and the first and second rails 6, 7 may be indirectly affixed to the mounting surface 11 via the back plate 58 instead of being directly affixed to the mounting surface 11.

In one example, as shown in FIG. 3, the back plate 58 may include a first portion 60, a second portion 62, and arm portions 64*a*, 64*b*. The first portion 60 is adapted to be disposed adjacent an entirety of the panel 12 where the panel 12 is in the opened position (shown in FIGS. 1, 4, and 6). The first portion 60 may also be adapted to permanently cover a portion of the window 10 over which the main body 4 of the security panel system 2 is disposed. The back plate 58 may also have a second portion 62 that is spaced apart from the first portion 60. For example, the two arm portions 64*a*, 64*b* may connect the first portion 60 to the second portion 62. The second portion 62 is adapted to cover the first end of the panel 12, where the panel 12 is in the closed position (shown in FIGS. 2, 5, and 7).

As shown in FIG. 3, the arm portions 64*a*, 64*b* may also be spaced apart from each other, creating an open space 66 that is defined as the area between each of the arm portions 64*a*, 64*b*, the first portion 60, and the second portion 62 of the back plate 58. The open space 66 of the back plate 58 is disposed adjacent the window 10 upon the back plate 58 being affixed to the mounting surface 11. It should be appreciated that the open space 66 allows the window 10 to remain visible where the panel 12 is in the opened position.

Although the back plate 58 is described and shown in FIGS. 1-7 as being substantially rectangular in shape, it should be appreciated that the back plate 58 may be any suitable shape chosen by a skilled artisan. For example, the back plate 58 may be generally U-shaped (not shown) having only a single on of the first and second portion 60, 62 with two arm portions 64*a*, 64*b* extending therefrom.

With renewed reference to FIG. 3, the first portion 60 of the back plate 58 may have a maximum width (W8) between about ten inches (10") and about sixteen inches (16"), and most particularly about thirteen inches (13"). The second portion 62 of the back plate 58 may have a maximum width (W9) between about two inches (2") and about four inches (4"), and most particularly about three inches (3"). The first portion 60 and the second portion 62 of the back plate 58 may each have a length (L4) between about thirty-six inches (36") and about forty-four inches (44"), and most particularly about forty inches (40"). The arm portions 64*a*, 64*b* may be of a width that is equal to or greater than the width of the first inner member 14 and the second inner member 15 of the first and second rails 6, 7. However, it should be appreciated that all of these dimensions are provided for purpose of illustrating one embodiment of the security panel system 2, and one skilled in the art may select any other dimensions for the back plate 58, as desired.

In an exemplary embodiment, and as with the first and second rails 6, 7 and the panel 12 described hereinabove, the back plate 58 may be manufactured with a bullet resistant material. As non-limiting example, suitable materials may include steel, KEVLAR® aramid polymer, LEXAN® polycarbonate, carbon fiber composite materials, titanium, and combinations thereof. In a most particular example, and similar to that described hereinabove with respect to the panel 12, the back plate 58 may be about a 7-gauge steel (about 0.1875 inch in thickness). However, any other suitable material and thickness may be chosen for the back plate 58 within the scope of the instant disclosure.

Figure 8:
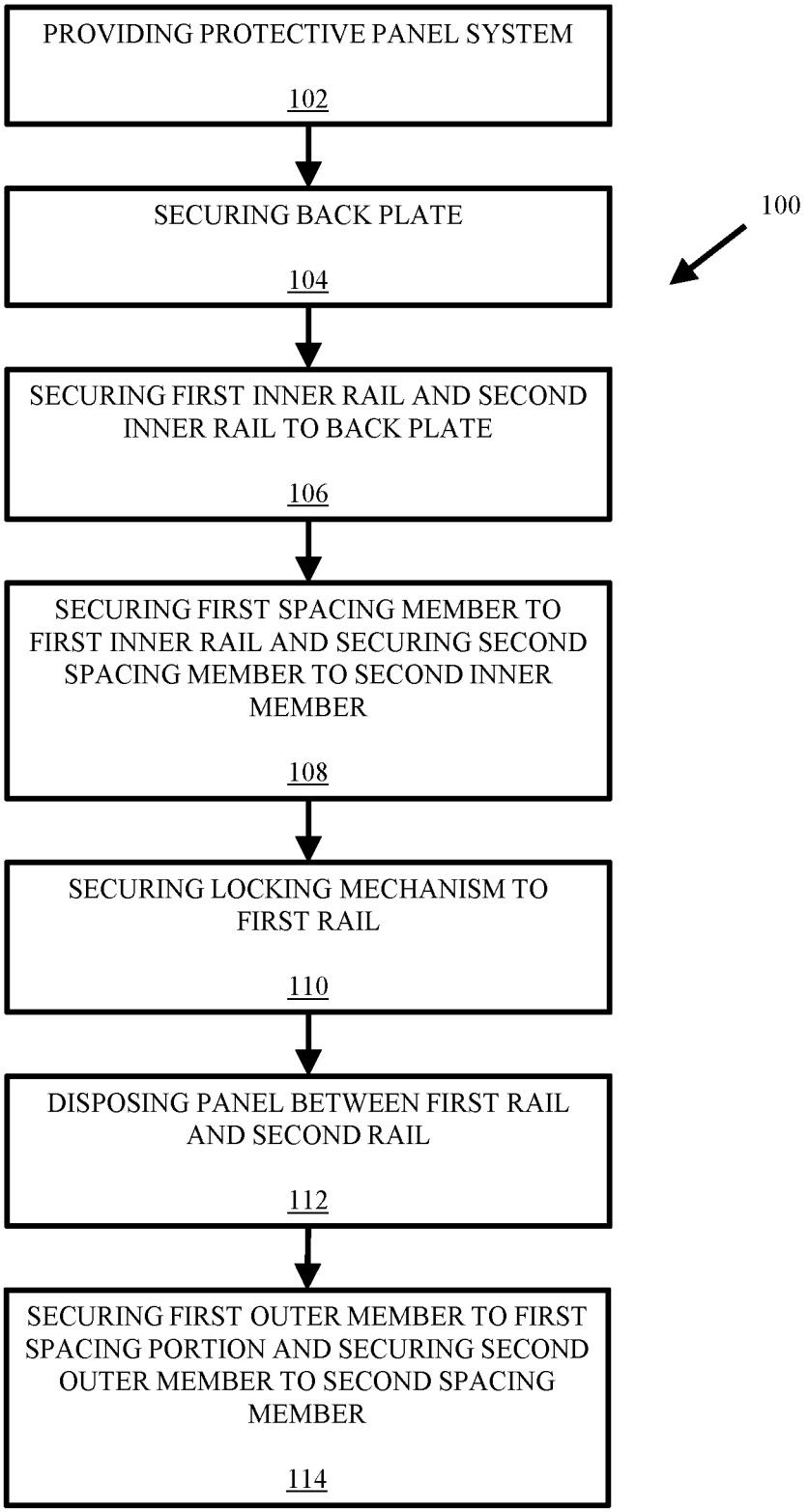
FIG. 8 is a flow diagram illustrating a method for mounting the security panel system shown in FIGS. 1-7 according to one embodiment of the present disclosure.

With reference to FIG. 8, the protective panel 12 system 2 may be secured to the mounting surface 11 using the method 100. The method 100 includes a first step 102 of providing the components of the security panel system 2 as described hereinabove. The method may include a second step 104 of securing the back plate 58 to the mounting surface 11 with some of the fasteners 32. For example, the back plate 58 may be mounted with the window 10 disposed in the open space 66 formed between the first portion 60, the second portion 62, the first arm portion 64*a*, and the second arm portion 64*b*. In the second step 104, the fasteners 32 may be disposed through flange portions in either of the first portion 60 and the second portion 62 so as to not interfere with the subsequent assembly over the other components onto the back plate 58.

In a third step 106, the first inner member 14 of the first rail 6 and the second inner member 15 of the second rail 7 may each be mounted to the back plate 58, for example, with some of the fasteners 32. The method may further include a fourth step 108 of securing the first spacing portion 16*a* and the second spacing portion 16*b* to the first inner member 14 of the first rail 6. The fourth step 108 may also include a securing of the second spacing member 17 to the second inner member 15 of the second rail 7. In a fifth step 110, the locking mechanism 28 may be disposed between the first spacing portion 16*a* and the second spacing portion 16*b* of the first spacing member 16*a*, 16*b*.

The method 100 may also include a sixth step 112, where the panel 12 is disposed between the first rail 6 and the second rail 7. In particular, the first end portion 22 of the panel 12 may be disposed in the first channel 20 of the first rail 6, while the second end portion 24 of the panel 12 may be disposed in the second channel 21 of the second rail 7. In a seventh step 114, the first outer member 18 may be secured to the first spacing member 16*a*, 16*b* of the first rail 6, and over the first end portion 22 of the panel 12. The second outer member 19 may also be secured to the second spacing member 17 of the second rail 7, and over the second end portion 24 of the panel 12. This completes the assembly of the first and second rails 6, 7, and permits the panel 12 to be moved between the opened position and the closed position in operation.

As described hereinabove, and as shown in FIGS. 1-7, each of the components of the security panel system 2 may be secured to the mounting surface 11, either individually or together with other ones of the components, using the plurality of fasteners 32. However, it should be appreciated that the protective mounting system 2 may be secured to the mounting surface 11 using any other suitable method, as desired.

In operation, where there is an emergency or active shooter situation, the user may grip the handle 54 of the panel 12 and move the panel 12 from the default opened position and into the closed position. By the mere action of moving the panel 12 to the closed position, the locking mechanism 28 will also move from the unlocked position to the locked position under the force of gravity, for example. This action likewise secures the panel 12 in the closed position and militates against the active shooter both shooting through the window 10 and viewing the occupants of the room through the window 10. Once the environment has been deemed safe and the emergency or active shooter situation has been resolved, the user may manually pull the bolt body of the locking mechanism upwardly to the unlocked position and return the panel 12 to the opened position where the window 10 is again uncovered.

It should be understood that the security panel system 2 of the present disclosure may be provided in the form of a kit including the back plate 58, the first rail 6 (or its separate and individual components), the second rail 7 (or its separate and individual components), the panel 12, the locking mechanism 28, and the plurality of fasteners 32. Other suitable components for the kit, including tools for assembly, may also be provided.

Advantageously, the security panel system 2 of the present disclosure may cover the window 10 and militate against a would-be shooter from both viewing and shooting the occupants in the room by firing through the window 10.

While certain representative embodiments and details have been shown for purposes of illustrating the invention, it will be apparent to those skilled in the art that various changes may be made without departing from the scope of the disclosure, which is further described in the following appended claims.

What is claimed is:

1. A security panel system, comprising:

a main body having a first rail, a second rail, a panel, and a locking mechanism, the first rail having a first channel and the second rail having a second channel, the panel received by the first channel of the first rail and the second channel of the second rail, the panel selectively movable in a substantially horizontal direction between an opened position and a closed position, the locking mechanism configured to secure the panel in the closed position, the locking mechanism configured to automatically move from an unlocked position to a locked position under the force of gravity, and the main body configured to attach to a mounting surface.

2. The security panel system of claim 1, wherein the first rail has a first inner member, a first spacing member, and a first outer member, which together upon assembly define the first channel.

3. The security panel system of claim 2, wherein the first spacing member includes a first spacing portion and a second spacing portion, and the first spacing portion is spaced apart from the second spacing portion to define a gap therebetween.

4. The security panel system of claim 3, wherein the locking mechanism is movably disposed in the gap between the first spacing portion and the second spacing portion.

5. The security panel system of claim 2, wherein the second rail has a second inner member, a second spacing member, and a second outer member, which together upon assembly define the second channel.

6. The security panel system of claim 5, wherein the first channel of the first rail faces the second channel of the second rail.

7. The security panel system of claim 6, wherein the panel has a first end portion and a second end portion, the first end portion of the panel being disposed in the first channel of the first rail and spaced apart from the first spacing member, and the second end portion of the panel being disposed in the second channel of the second rail and slidably abutting the second spacing member.

8. The security panel system of claim 7, wherein a recess is formed in the first end portion of the panel, and the recess is adapted to receive the locking mechanism where the door is in the closed position.

9. The security panel system of claim 8, wherein the recess is formed at a first corner of the first end portion of the panel, the first corner having a first step and a second step, and the first step is configured to receive the locking mechanism where the door is in the closed position.

10. The security panel system of claim 9, wherein the first rail has at least one secondary spacing member disposed in the first channel.

11. The security panel system of claim 10, wherein the second step of the first corner of the first end portion of the panel is configured to abut the at least one secondary spacing member in the first channel of the first rail where the panel is in the opened position.

12. The security panel system of claim 11, wherein an indentation is formed at a second corner of the first end portion of the panel, and the second corner is configured to abut the at least one secondary spacing member where the panel is in the closed position.

13. The security panel system of claim 1, wherein the main body includes a back plate, the first rail and the second rail are secured to the back plate, the back plate is configured to provide a substantially uniform mounting area, and the back plate is configured to be attached to the mounting surface.

14. The security panel system of claim 13, wherein the back plate has a first portion, a second portion, a first arm portion and a second arm portion.

15. The security panel system of claim 14, wherein the panel and the back plate are formed from a bullet-resistant material.

16. The security panel system of claim 1, wherein the locking mechanism includes a bolt body, the bolt body having an elongate aperture formed therethrough and a grip portion formed at one end of the bolt body, the grip portion disposed above the elongate aperture and an upper surface of the first rail.

17. A method of securing a room with a window, the method comprising the steps of:

providing a security panel system including a main body having a first rail, a second rail, a panel, and a locking mechanism, the first rail having a first channel and the second rail having a second channel, the panel received by the first channel of the first rail and the second channel of the second rail, the panel selectively movable in a substantially horizontal direction between an opened position and a closed position, the locking mechanism configured to secure the panel in the closed position, the locking mechanism configured to automatically move from an unlocked position to a locked position under the force of gravity, and the main body configured to attach to a mounting surface;

providing the mounting surface with the window;

securing the first rail adjacent to the window;

securing the second rail adjacent to the window; and disposing the panel between the first rail and the second rail, the window fully covered where the panel is moved to the closed position, whereby an occupant of the room is not viewable by an assailant outside the window.

18. The method of claim 17, wherein the main body of the security panel system includes a back plate, and the method further includes a step of mounting the back plate adjacent to the window, and the steps of securing the first rail and the second rail adjacent to the window include mounting the first rail and the second rail to the back plate.

19. A kit for a security panel system, comprising:

a panel configured to be selectively movable in a substantially horizontal direction between an opened position and a closed position, a first rail having a first channel, and a second rail having a second channel, the first rail and the second rail configured to attach to a mounting surface, each of the first channel of the first rail and the second channel of the second rail configured to receive the panel, and a locking mechanism configured to be attached to the first rail and secure the panel in the closed position, the locking mechanism configured to automatically move from an unlocked position to a locked position under the force of gravity.

20. The security panel system kit of claim 19, further comprising a back plate configured to be mounted to the mounting surface and to be attached to each of the first rail and the second rail, the back plate is configured to provide a substantially uniform mounting area.

* * * * *